US008894850B2

(12) United States Patent
Coscarella

(10) Patent No.: US 8,894,850 B2
(45) Date of Patent: Nov. 25, 2014

(54) DRAIN COVER WITH LOCKING MECHANISM

(76) Inventor: Gabe Coscarella, Edmonton (CA)

( * ) Notice: Subject to any disclaimer, the term of this patent is extended or adjusted under 35 U.S.C. 154(b) by 744 days.

(21) Appl. No.: 12/950,951

(22) Filed: Nov. 19, 2010

(65) Prior Publication Data

US 2011/0120924 A1 May 26, 2011

(30) Foreign Application Priority Data

Nov. 20, 2009 (CA) ..... 2686031

(51) Int. Cl.
*E03F 5/14* (2006.01)

(52) U.S. Cl.
USPC ..... 210/164; 210/163; 210/460; 210/232; 285/42; 285/245; 285/343; 285/346

(58) Field of Classification Search
None
See application file for complete search history.

(56) References Cited

U.S. PATENT DOCUMENTS

| | | | | | |
|---|---|---|---|---|---|
| 402,600 | A | * | 5/1889 | Kemp | 220/235 |
| 667,333 | A | | 2/1901 | Pflugh | |
| 739,589 | A | | 9/1903 | Clifford | |
| 993,661 | A | * | 5/1911 | Dudley | 285/339 |
| 1,640,969 | A | | 8/1927 | Westerman | |
| 1,771,522 | A | | 7/1930 | Berge | |
| 1,999,277 | A | * | 4/1935 | Boosey | 210/163 |
| 2,277,713 | A | | 3/1942 | Parker | |
| 2,740,490 | A | * | 4/1956 | Matheis | 210/166 |
| 2,773,554 | A | * | 12/1956 | Lindorf | 138/90 |
| 2,893,437 | A | | 7/1959 | Rickard | |
| 3,148,708 | A | | 9/1964 | Panella | |
| 3,291,156 | A | * | 12/1966 | Corsano | 138/89 |
| 3,578,200 | A | | 5/1971 | Hetzer | |
| 3,599,825 | A | * | 8/1971 | Jorgensen | 220/327 |
| 3,675,685 | A | | 7/1972 | Potter | |
| 3,747,541 | A | * | 7/1973 | Reese | 109/50 |
| 3,809,411 | A | * | 5/1974 | Emberson | 285/42 |
| 3,893,487 | A | | 7/1975 | Engelking | |
| 3,893,919 | A | * | 7/1975 | Flegel et al. | 210/166 |
| 3,911,635 | A | * | 10/1975 | Traupe | 52/220.1 |
| 3,993,102 | A | | 11/1976 | Polster | |
| 4,035,297 | A | * | 7/1977 | Aldridge et al. | 210/163 |
| 4,312,708 | A | * | 1/1982 | Leslie | 376/203 |
| 4,432,465 | A | * | 2/1984 | Wuertz | 220/235 |
| 4,455,693 | A | * | 6/1984 | Cuschera | 4/286 |
| 4,493,344 | A | * | 1/1985 | Mathison et al. | 138/89 |
| 4,505,499 | A | * | 3/1985 | Uglow et al. | 285/42 |
| 4,585,033 | A | * | 4/1986 | Westman | 138/89 |
| 4,723,440 | A | * | 2/1988 | Bershausen | 73/40 |
| 4,753,461 | A | * | 6/1988 | Miller | 285/338 |
| 4,799,713 | A | * | 1/1989 | Uglow | 285/42 |
| 4,850,617 | A | * | 7/1989 | Moberly | 285/42 |

(Continued)

*Primary Examiner* — Robert James Popovics
(74) *Attorney, Agent, or Firm* — Christensen O'Connor Johnson Kindness PLLC

(57) ABSTRACT

A drain cover with a locking mechanism which has a cylindrical body with a first end, a second end, an end wall at the first end and a peripheral sidewall that extends between the first end and the second end. The peripheral sidewall has an exterior surface and an interior surface which defines an interior bore. A wedge member positioned at the second end of the peripheral sidewall and is movable from a release position to a locking position. In the release position each wedge member is positioned at the second end of the peripheral sidewall. In the locking position each wedge member is moved up the exterior surface of the peripheral sidewall toward the first end. Means are provided for moving each wedge member from the release position to the locking position.

2 Claims, 7 Drawing Sheets

(56) References Cited

U.S. PATENT DOCUMENTS

| | | | | | |
|---|---|---|---|---|---|
| 4,871,451 | A | * | 10/1989 | Piskula | 210/164 |
| 4,984,308 | A | * | 1/1991 | Handal | 4/252.6 |
| 5,035,265 | A | * | 7/1991 | Chen | 138/89 |
| 5,038,830 | A | * | 8/1991 | Arnaud | 138/89 |
| 5,044,403 | A | * | 9/1991 | Chen | 138/89 |
| 5,054,956 | A | * | 10/1991 | Huang | 404/26 |
| 5,071,177 | A | * | 12/1991 | Spiess et al. | 292/91 |
| 5,090,737 | A | * | 2/1992 | Brammer et al. | 285/39 |
| 5,141,633 | A | * | 8/1992 | Walczak et al. | 210/163 |
| 5,234,582 | A | * | 8/1993 | Savoie | 210/163 |
| 5,297,817 | A | * | 3/1994 | Hodges | 285/15 |
| 5,469,670 | A | * | 11/1995 | Thaler | 52/12 |
| 5,695,222 | A | * | 12/1997 | Hodges | 285/3 |
| 5,797,431 | A | * | 8/1998 | Adams | 138/89 |
| 5,918,638 | A | * | 7/1999 | Davis | 138/89 |
| 5,966,884 | A | * | 10/1999 | Uglow | 52/302.1 |
| 6,165,357 | A | * | 12/2000 | Cormier | 210/163 |
| 6,209,572 | B1 | * | 4/2001 | Wicklund | 137/315.01 |
| 6,453,603 | B1 | * | 9/2002 | Baker | 43/124 |
| 6,647,682 | B2 | * | 11/2003 | Bishop | 52/302.1 |
| 7,121,526 | B2 | | 10/2006 | Alvarez | |
| 7,171,987 | B2 | | 2/2007 | Serret | |
| 7,278,450 | B1 | * | 10/2007 | Condon | 138/89 |
| 7,300,573 | B1 | * | 11/2007 | Trangsrud | 210/163 |
| 7,600,644 | B2 | * | 10/2009 | McCallum | 210/459 |
| 8,496,811 | B2 | * | 7/2013 | Cohen | 210/163 |
| 8,557,109 | B1 | * | 10/2013 | Sutherland | 210/163 |
| 8,628,657 | B1 | * | 1/2014 | Robillard et al. | 210/163 |
| 2006/0283792 | A1 | * | 12/2006 | McCallum | 210/459 |
| 2011/0120924 | A1 | * | 5/2011 | Coscarella | 210/164 |
| 2012/0199215 | A1 | * | 8/2012 | Cohen | 137/362 |

* cited by examiner

DRAIN COVER WITH LOCKING MECHANISM

FIELD

There is described a locking mechanism for securing in place a cover that prevents objects from falling down drains and other vertical pipes.

BACKGROUND

Drain covers serve an important function of preventing objects from falling down drains. There is a need for a locking mechanism for securing the drain covers in place, so that they are not readily removed.

SUMMARY

There is provided a drain cover with a locking mechanism. A cylindrical body is provided having a first end, a second end, an end wall at the first end and a peripheral sidewall that extends between the first end and the second end. The peripheral sidewall has an exterior surface and an interior surface which defines an interior bore. At least one wedge member is positioned at the second end of the peripheral sidewall and is movable from a release position to a locking position. In the release position, each wedge member is positioned at the second end of the peripheral sidewall. In the locking position, each wedge member is moved up the exterior surface of the peripheral sidewall toward the first end. In the embodiment that will hereinafter be described rotatable fasteners are used as means for moving each wedge member from the release position to the locking position.

The drain cover, as described above, can readily be placed in the locking position by movement of each wedge member. Beneficial results have been obtained through the use of a single annular wedge member. One distinct advantage this drain cover has over other drain covers, is that a central flow path is left free of any obstacles that might otherwise catch debris.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
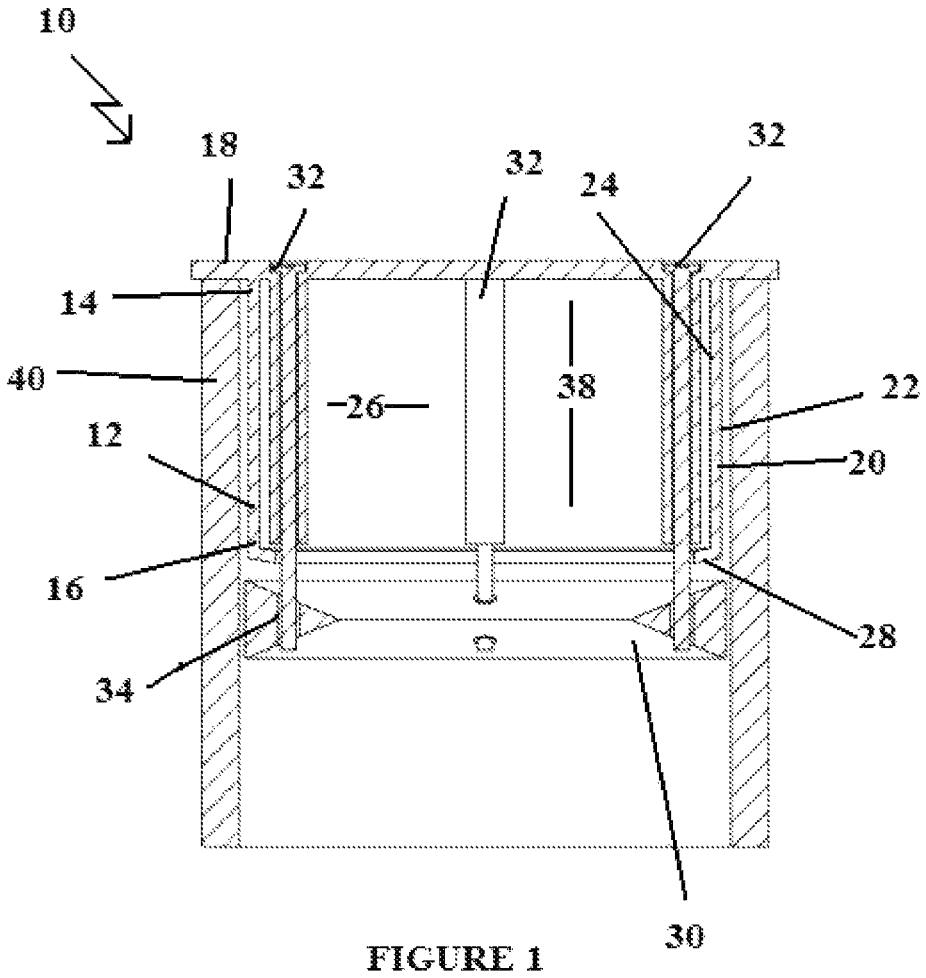
FIG. 1 is a side elevation view in section of the drain cover in accordance

Structure and Relationship of Parts:

A drain cover generally identified by reference numeral 10, will now be described with reference to FIG. 1 through 7.

Referring to FIG. 1 there is illustrated a drain cover 10 with a locking mechanism, which has a cylindrical body 12 with a first end 14, a second end 16, an end wall 18 at first end 14 and a peripheral sidewall 20 that extends between first end 14 and second end 16. Peripheral sidewall 20 has an exterior surface 22 and an interior surface 24 which defines an interior bore 26. Peripheral sidewall 20 terminates in an lip 28 which angles inward.

Figure 2:
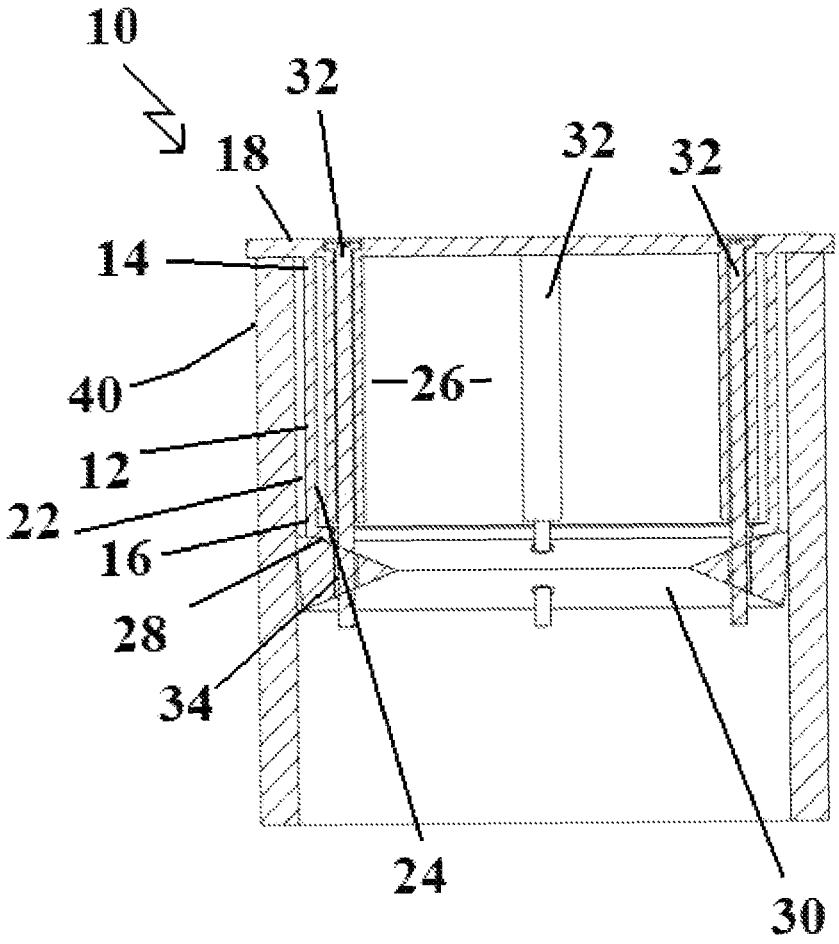
FIG. 2 is a side elevation view in section of the drain cover in illustrated in FIG. 1, in the locking position.

A wedge member 30 positioned at second end 16 of peripheral sidewall 20. Wedge member 30 is movable from a release position illustrated in FIG. 1 to a locking position as illustrated in FIG. 2. Referring to FIG. 1, in the release position, wedge member 30 is positioned at second end 16 of peripheral sidewall 20. Referring to FIG. 2, in the locking position wedge member 30 is moved up exterior surface 22 of peripheral sidewall 20 toward first end 14.

Figure 3:
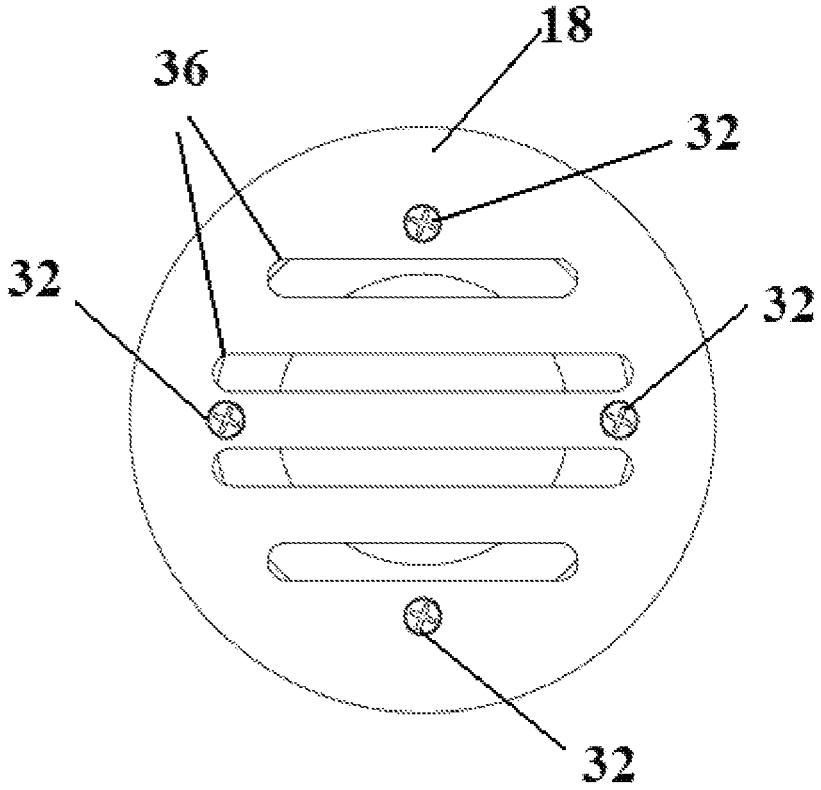
FIG. 3 is a top plan view of the drain cover.

Referring to FIGS. 1 and 2, several rotatable fasteners 32 are provided for moving wedge member 30 from the release position to the locking position. Referring to FIG. 3, there are four rotatable fasteners 32 illustrated although it will be appreciated that there could be more or fewer and still operate to move wedge member 30. Rotatable fasteners 32 are threaded and pass through threaded sleeves 34 provided in wedge member 30.

Figure 4:
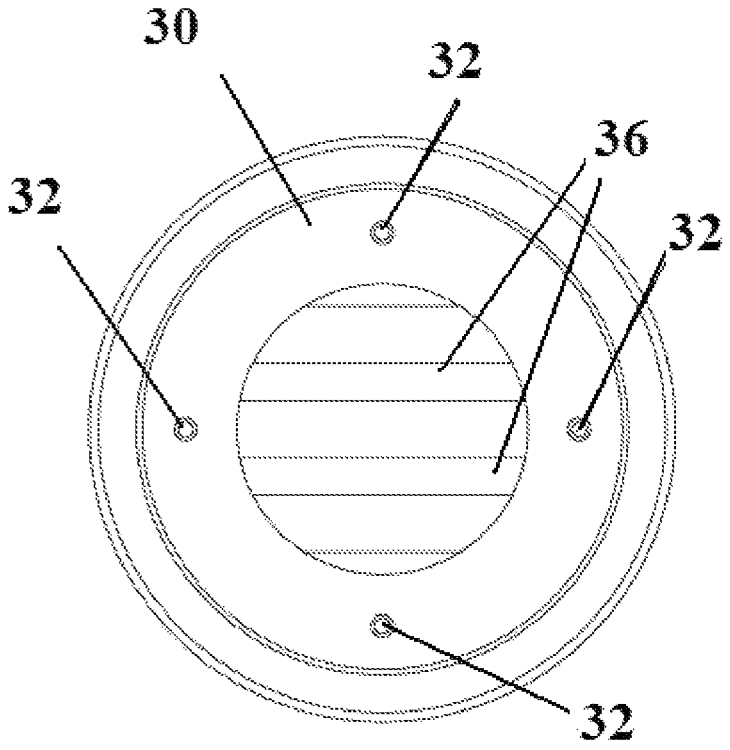
FIG. 4 is a bottom plan view of the drain cover.

Referring to FIGS. 3 and 4, end wall 18 has drainage openings 36 which allow flow through a central flow path 38 provided by interior bore 26 as illustrated in FIG. 1, which is left free of any obstacles that might otherwise catch debris. Alternatively, end wall 18 could also be devoid of any drainage openings 36.

Figure 5:
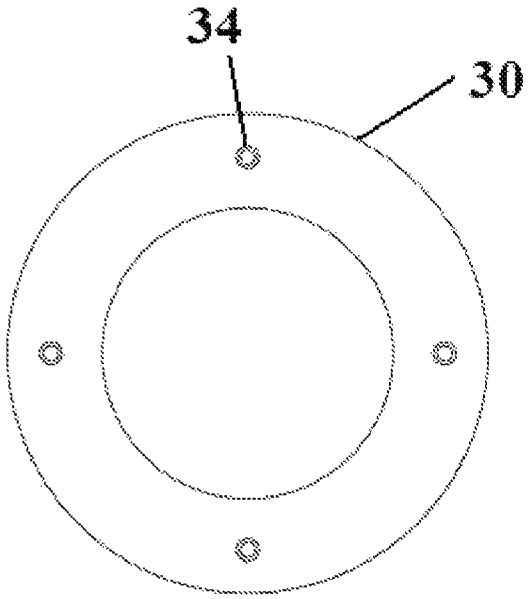
FIG. 5 is top plan view of a wedge shaped member of the drain cover illustrated in FIG. 1.
Figure 6:
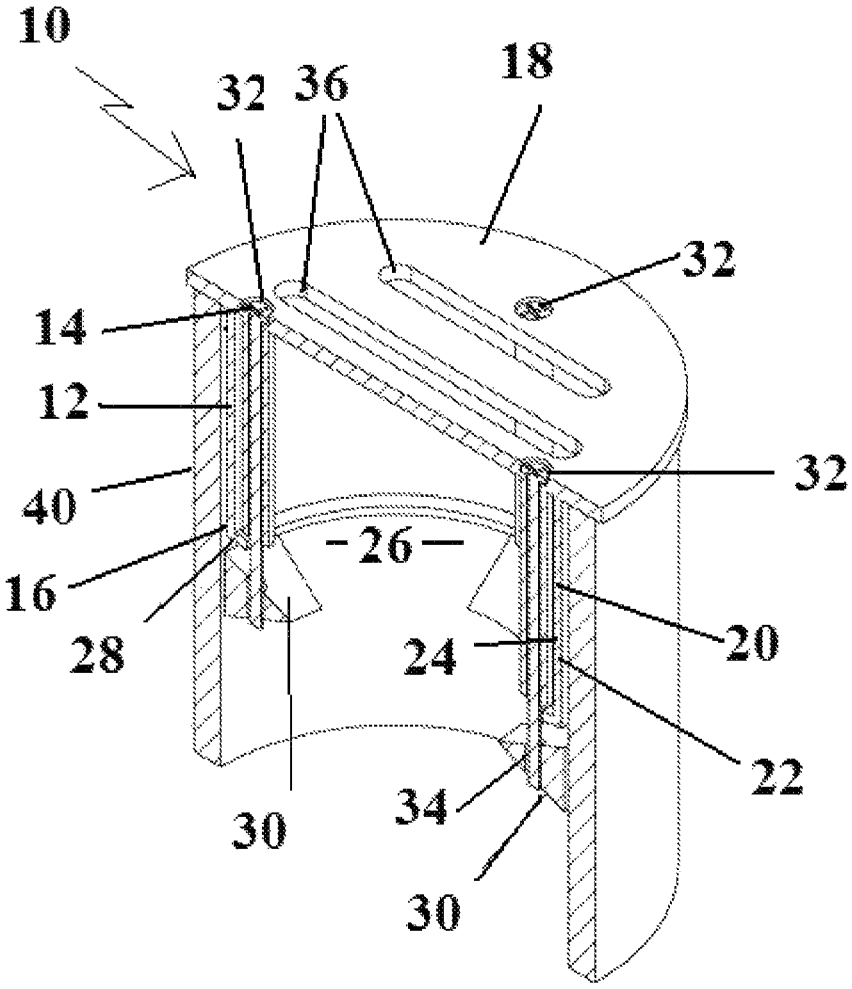
FIG. 6 is a perspective view in section of the drain cover.

It will be appreciated that while the illustrated embodiment 10 shows a single annular wedge member 30 as illustrated in FIG. 5, there could be more than one annular wedge member 30 disposed about peripheral sidewall 20 as illustrated in FIG. 6. In FIG. 6, four wedge members 30 are disposed about peripheral sidewall 20.

Operation:

The use and operation of drain cover 10 will now be described with reference to FIGS. 1 through 7.

Referring to FIG. 1, drain cover 10 is placed in a pipe 40 while in the release position. Once drain cover 10 is properly positioned in pipe 40, rotatable fasteners 32 can be rotated. Referring to FIG. 2, as rotatable fasteners 32 are rotated, wedge member 30 is moved up exterior surface 22 of peripheral sidewall 20 toward first end 14. When wedge member 30 impinges on lip 28 then wedge member 30 bulges out into engagement with pipe 40 thereby placing it in the locking position. Once locked in position, drain cover 10 will remain in place until it is desirable to remove drain cover 10 from pipe 40. To remove drain cover 10, rotatable fasteners 32 are loosened such that wedge member 30 is moved back to the release position illustrated in FIG. 1, and drain cover 10 can be removed from pipe 40.

Figure 7:
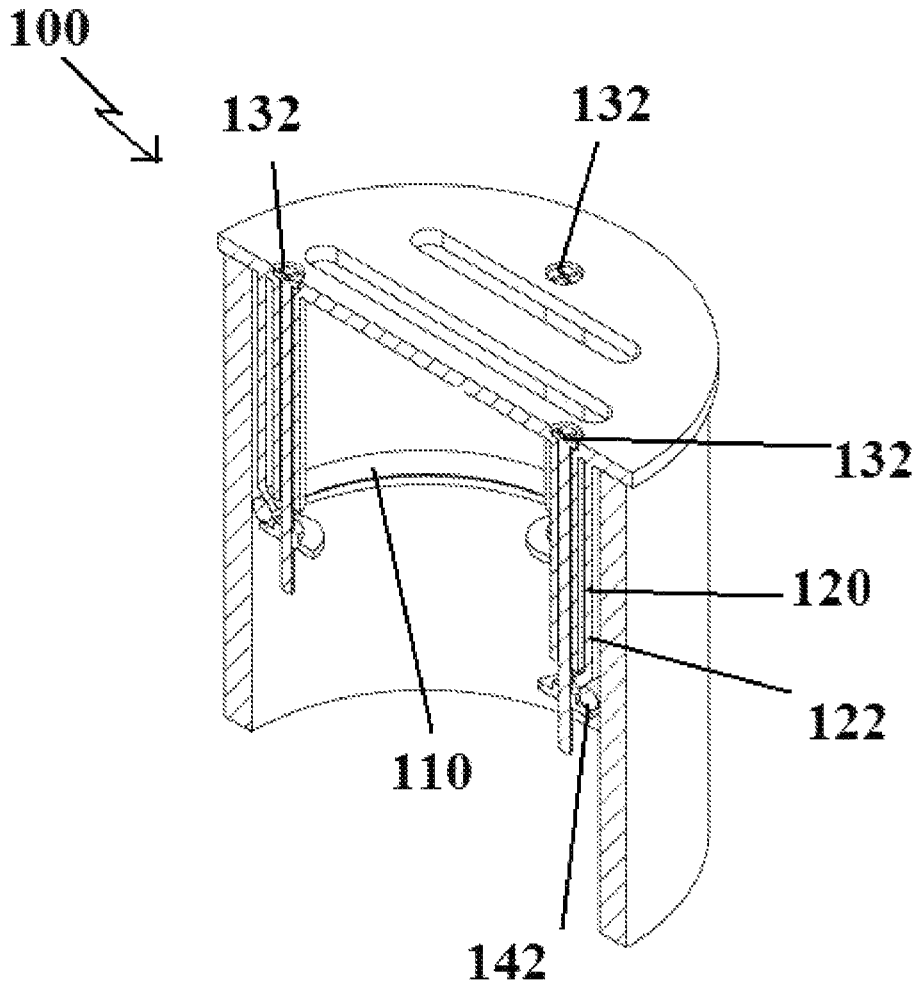
FIG. 7 is a perspective view in section of a second embodiment of the drain cover.

Variations:

Referring to FIG. 7, there is illustrated an alternative embodiment generally referenced by numeral 100. Alternative embodiment 100 is similar to first embodiment 10 illustrated in FIG. 1, except in that embodiment 100 uses an o-ring 110 as wedge member 30. Rotatable fasteners 132 do not pass through o-ring, but rather terminate in a nut 142. Nut 142 serves to move o-ring 110 up exterior surface 122 of peripheral sidewall 120 toward first end 114 into the locking position when rotatable fasteners are rotated.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A drain cover assembly with a locking mechanism, said assembly comprising:

a hollow cylindrical body defining an interior bore and having a first end and a second end;

an end wall having a plurality of drain openings therein and being connected to said first end of said hollow cylindrical body;

at least one wedge member having threaded sleeves therein and being positioned at said second end of said hollow cylindrical body; and a plurality of threaded, rotatable fasteners extending through fastener openings in said end wall, wherein said second end of said hollow cylindrical body and said at least one wedge member are inserted into a receiving pipe until said end wall engages an end of said receiving pipe, said threaded, rotatable fasteners being threadably received in said threaded sleeves, and upon rotation of said fasteners, said at least one wedge member impinges upon said second end of said hollow cylindrical body and bulges out into engagement with an interior surface of said receiving pipe, causing said drain cover assembly to be locked in place.

2. The drain cover assembly of claim 1, wherein said at least one wedge member is a single annular wedge.

* * * * *